US011569018B2

(12) United States Patent
Inaba et al.

(10) Patent No.: US 11,569,018 B2
(45) Date of Patent: Jan. 31, 2023

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Kazuhiro Inaba, Mie (JP); Kouhei Yoshikawa, Mie (JP)

(73) Assignees: AutoNetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 623 days.

(21) Appl. No.: 16/603,624

(22) PCT Filed: Apr. 10, 2018

(86) PCT No.: PCT/JP2018/015119
§ 371 (c)(1),
(2) Date: Oct. 8, 2019

(87) PCT Pub. No.: WO2018/198762
PCT Pub. Date: Nov. 1, 2018

(65) Prior Publication Data

US 2020/0111596 A1 Apr. 9, 2020

(30) Foreign Application Priority Data

Apr. 27, 2017 (JP) ..... JP2017-088993

(51) Int. Cl.
*H01F 27/24* (2006.01)
*H01F 27/255* (2006.01)
(Continued)

(52) U.S. Cl.
CPC ..... *H01F 27/255* (2013.01); *H01F 27/263* (2013.01); *H01F 27/2823* (2013.01); *H01F 37/00* (2013.01); *H01F 41/12* (2013.01)

(58) Field of Classification Search
CPC ..... H01F 27/2823
(Continued)

(56) References Cited

U.S. PATENT DOCUMENTS

2015/0279550 A1* 10/2015 Kitami ..... H01F 27/24 336/205

FOREIGN PATENT DOCUMENTS

JP 2010-238798 A 10/2010
JP 2013-135191 A 7/2013
(Continued)

OTHER PUBLICATIONS

English translation of JP 2010238798 (Year: 2010).*
(Continued)

*Primary Examiner* — Ronald Hinson
(74) *Attorney, Agent, or Firm* — Honigman LLP

(57) ABSTRACT

A reactor includes a coil having a winding portion, and a magnetic core including a core piece having an inner core portion disposed inside the winding portion. The core piece is a compact made of a composite material that contains a magnetic powder and a resin. The reactor further includes: a first projection that is integrated with and projects from an outer peripheral face of the inner core portion, and comes into contact with an inner peripheral face of the winding portion so as to position the winding portion in a diameter direction of the winding portion, and a second projection that is integrated with and projects from the core piece at a position opposing an end face of the winding portion, and
(Continued)

3:3A, 3B comes into contact with the end face of the winding portion so as to position the winding portion in an axial direction thereof.

18 Claims, 3 Drawing Sheets

(51) Int. Cl.
*H01F 27/26* (2006.01)
*H01F 27/28* (2006.01)
*H01F 37/00* (2006.01)
*H01F 41/12* (2006.01)

(58) Field of Classification Search
USPC ..... 336/212
See application file for complete search history.

(56) References Cited

FOREIGN PATENT DOCUMENTS

| | | | |
|---|---|---|---|
| JP | 2013-239732 | A | 11/2013 |
| JP | 2015-201487 | A | 11/2015 |
| JP | 2016-149453 | A | 8/2016 |
| WO | 2015-190215 | A1 | 12/2015 |

OTHER PUBLICATIONS

English translation of WO 2015190215 (Year: 2015).*
International Search Report, Application No. PCT/JP2018/015119, dated Jun. 26, 2018. ISA/Japan Patent Office.

* cited by examiner

REACTOR

CROSS-REFERENCE TO RELATED APPLICATIONS

This application is the U.S. national stage of PCT/JP2018/015119 filed on Apr. 10, 2018, which claims priority of Japanese Patent Application No. JP 2017-088993 filed on Apr. 27, 2017, the contents of which are incorporated herein.

TECHNICAL FIELD

The present disclosure relates to a reactor.

BACKGROUND

A reactor is one component in a circuit for performing voltage step-up and step-down. For example, JP 2013-135191A discloses a reactor that includes an assembly constituted by a coil provided with a pair of coil elements (winding portions), and a loop-shaped magnetic core that is disposed extending inside and outside the coil elements. The reactor (assembly) disclosed in JP 2013-135191A includes a bobbin that is arranged between the coil and the magnetic core.

In JP 2013-135191A, the bobbin is constituted by inner bobbins that are disposed at the outer peripheral faces of inner core portions of the magnetic core that are disposed inside the coil elements, and frame-shaped bobbins that abut against the end faces of the coil. It is also disclosed that the magnetic core is obtained by combining a plurality of divided core portions (core pieces), and the inner core portions are obtained by alternatingly stacking the divided core portions and gap plates.

Recent years have seen an increase in demand for vehicles such as hybrid automobiles, and this has been accompanied by demand for further improvements in the productivity of reactors used in in-vehicle converters, as well as demand for cost reduction. In view of this, there is desire for the ability to position the coil and the magnetic core with a simple configuration and without using bobbins. There is also demand for further decreases in the size of reactors, and in view of this, there is desire for reduction in the size of the clearance between the inner peripheral faces of the winding portions and the outer peripheral faces of the inner core portions.

In the conventional reactor described above, inner bobbins are disposed between the inner peripheral faces of the winding portions and the outer peripheral faces of the inner core portions so as to position the winding portions in the diameter direction, and the frame-shaped bobbins are disposed abutting the end faces of the winding portions so as to position the winding portions in the axial direction. Accordingly, in the conventional reactor, bobbins (inner bobbins and frame-shaped bobbins) are used in order to position the coil and the magnetic core, and thus a large number of components are used. Also, the bobbins are generally formed from a resin and have a certain thickness (e.g., 2 mm or more) in order to ensure mechanical strength. For this reason, in the conventional reactor that has the inner bobbins disposed at the outer peripheral faces of the inner core portions, a large clearance is formed between the winding portions and the inner core portions. In the case where gaps are formed by disposing gap plates on the inner core portions as in the conventional reactor, there are cases where flux leakage penetrates into the winding portions through the gaps, and eddy current loss occurs in the winding portions.

In view of this, in the conventional reactor, in order to suppress the influence of flux leakage through the gaps, it has been necessary for the clearance between the winding portions and the inner core portions to be large to a certain extent. Accordingly, with the conventional reactor, there is a large number of components, it is difficult to meet demand for productivity improvements and cost reduction, and size reduction has been difficult due to the need to provide a large clearance between the winding portions and the inner core portions.

In view of this, an object of the present disclosure is to provide a reactor in which the coil and the magnetic core can be positioned with a simple configuration, and the size of the clearance between the winding portions and the inner core portions can be reduced.

SUMMARY

A reactor according to the present disclosure is a reactor including a coil having a winding portion, and a magnetic core including a core piece having an inner core portion disposed inside the winding portion, wherein the core piece is a compact made of a composite material that contains a magnetic powder and a resin. The reactor further includes: a first projection that is integrated with and projects from an outer peripheral face of the inner core portion, and comes into contact with an inner peripheral face of the winding portion so as to position the winding portion in a diameter direction of the winding portion; and a second projection that is integrated with and projects from the core piece at a position opposing an end face of the winding portion, and comes into contact with the end face of the winding portion so as to position the winding portion in an axial direction of the winding portion.

Advantageous Effects of the Present Disclosure

According to the reactor of the present disclosure, the coil and the magnetic core can be positioned with a simple configuration, and the size of the clearance between the winding portions and the inner core portions can be reduced.

DETAILED DESCRIPTION OF PREFERRED EMBODIMENTS

Figure 1:
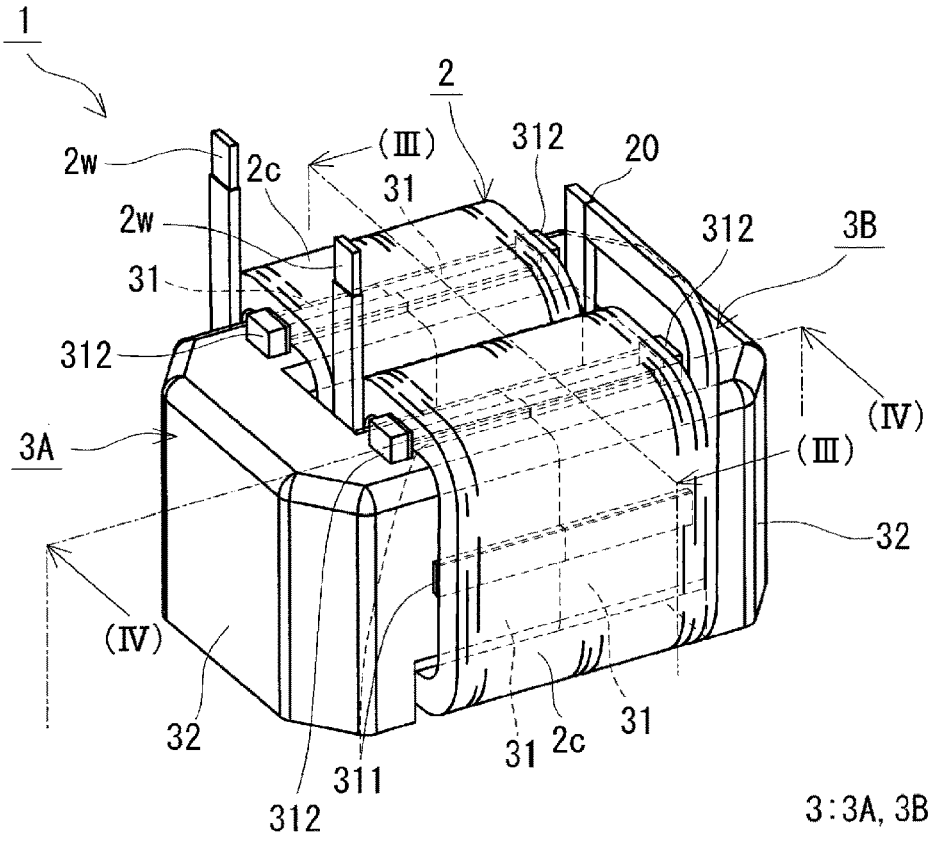
FIG. 1 is a schematic perspective view of a reactor according to a first embodiment.

First, embodiments of the present disclosure will be listed and described.

A reactor according to an aspect of the present disclosure is a reactor including a coil having a winding portion, and a magnetic core including a core piece having an inner core portion disposed inside the winding portion, wherein the core piece is a compact made of a composite material that contains a magnetic powder and a resin. The reactor further includes: a first projection that is integrated with and projects from an outer peripheral face of the inner core portion, and comes into contact with an inner peripheral face of the winding portion so as to position the winding portion in a diameter direction of the winding portion; and a second projection that is integrated with and projects from the core piece at a position opposing an end face of the winding portion, and comes into contact with the end face of the winding portion so as to position the winding portion in an axial direction of the winding portion.

If the core piece that constitutes the magnetic core is a compact made of a composite material that contains a magnetic powder and a resin, the composite material compact has a relatively low relative permeability, and therefore a gap for adjusting the inductance does not need to be provided in the magnetic core as in a conventional reactor, or even in the case of providing such a gap, the gap can be small. Therefore, according to the above reactor, the core piece that has the inner core portion is a composite material compact, thus making it unlikely for flux leakage to occur, which therefore makes it possible to reduce the size of the clearance between the inner peripheral face of the winding portion and the outer peripheral face of the inner core portion. Also, the above reactor further includes the first projection that is integrated with and projects from the outer peripheral face of the inner core portion, and the second projection that is integrated with and projects from the core piece at a position opposing the end face of the winding portion. The winding portion is positioned in the diameter direction relative to the inner core portion by the first projection, and the winding portion is positioned in the axial direction by the second projection, thus making it possible to position the coil relative to the magnetic core. For this reason, there is no need for bobbins that have been conventionally used (inner bobbins and frame-shaped bobbins), it is possible to reduce the number of components, and it is possible to improve productivity and achieve cost reduction. Furthermore, because it is possible to omit the inner bobbin that has been conventionally disposed between the winding portion and the inner core portion, the size of the clearance between the winding portion and the inner core portion can be reduced. Accordingly, with the above reactor, the coil and the magnetic core can be positioned with a simple configuration, and the size of the clearance between the winding portion and the inner core portion can be reduced. Accordingly, the number of components is reduced, and it is possible to meet demand for productivity and cost reduction, and also achieve compactness.

The composite material compact can be formed by being molded through a resin molding method such as injection molding or cast molding, and in the case where the core piece that includes the integrated first projection and second projection is constituted by a composite material compact, it is possible to easily achieve high dimensional precision. With the above reactor, the first projection that projects from the outer peripheral face of the inner core portion forms a clearance between the inner peripheral face of the winding portion and the outer peripheral face of the inner core portion (excluding the first projection).

In an aspect of the reactor, a height of the first projection is less than or equal to 1 mm.

If the height of the first projection is less than or equal to 1 mm, the clearance between the winding portion and the inner core portion can be made sufficiently small, and the size of the reactor can be further reduced. Although there are no particular limitations on the lower limit of the height of the first projection, the height is greater than or equal to 100 μm for example.

In an aspect of the reactor, a height of the second projection is greater than or equal to ⅓ of a width of the end face of the winding portion.

If the height of the second projection is greater than or equal to ⅓ of the width of the end face of the winding portion, the second projection is more likely to abut against the end face of the winding portion, and it is possible to effectively position the winding portion in the axial direction.

In an aspect of the reactor, the first projection is continuous over an entire length of the inner core portion.

If the first projection is continuous over the entire length of the inner core portion, there are no discontinuities in the first projection, and it is possible to suppress the case where some of the turns that form the winding portion shift in the diameter direction.

In an aspect of the reactor, the reactor further includes an insulation layer that is provided on an outer peripheral face of the first projection and is disposed between an inner peripheral face of the winding portion and the outer peripheral face of the first projection.

If the insulation layer is disposed on the outer peripheral face of the first projection, insulation between the winding portion and the inner core portion can be achieved more reliably.

In an aspect of the reactor, the reactor further includes an insulation layer that is provided on an inward end face of the second projection that opposes the end face of the winding portion, and is disposed between the end face of the winding portion and the inward end face of the second projection.

If the insulation layer is disposed on the inward end face of the second projection, insulation between the winding portion and the core piece can be achieved more reliably.

In an aspect of the reactor according to 5 or 6 above, a thickness of the insulation layer is less than or equal to 500 μm.

The thickness of the insulation layer need only be sufficient to ensure insulation between the winding portion (coil) and the core piece (magnetic core), and although there are no particular limitations on the thickness, if the insulation layer provided on the first projection for example is too thick, the size of the clearance between the winding portion and the inner core portion increases. If the thickness of the insulation layer is less than or equal to 500 μm, the clearance between the winding portion and the inner core portion can be made sufficiently small, and the size of the reactor can be further reduced. From the viewpoint of ensuring insulation between the winding portion and the core piece, the lower limit of the thickness of the insulation layer is preferably greater than or equal to 10 μm, for example.

Hereinafter, a concrete example of a reactor according to an embodiment of the present disclosure will be described with reference to the drawings. In the drawings, like reference numerals denote objects having like names. Note that the present disclosure is not limited to the following examples, but rather is defined by the claims, and all changes that come within the meaning and range of equivalency of the claims are intended to be embraced therein.

First Embodiment

Configuration of Reactor

Figure 2:
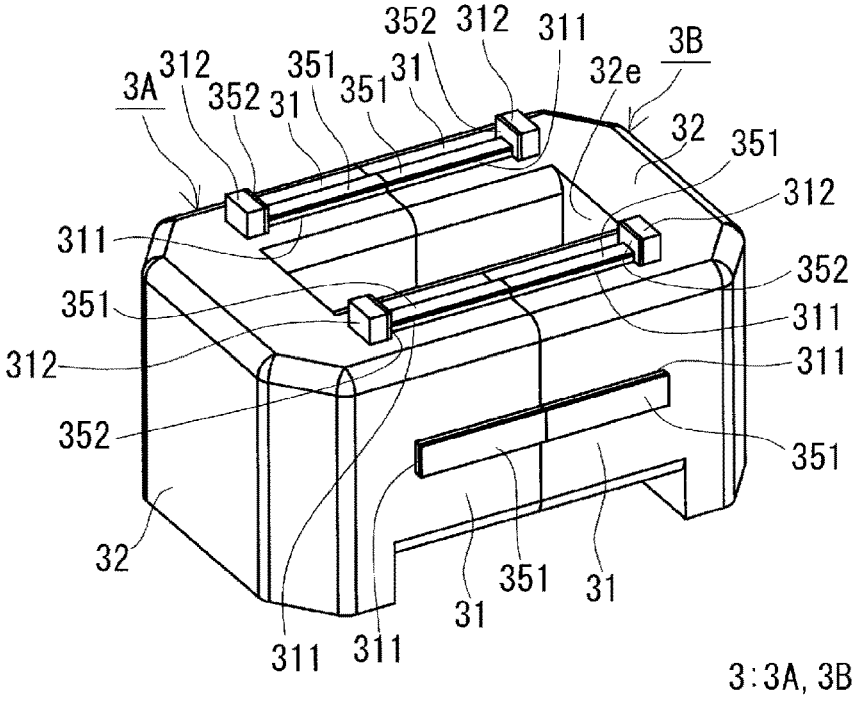
FIG. 2 is a schematic perspective view of a magnetic core included in the reactor according to the first embodiment.
Figure 3:
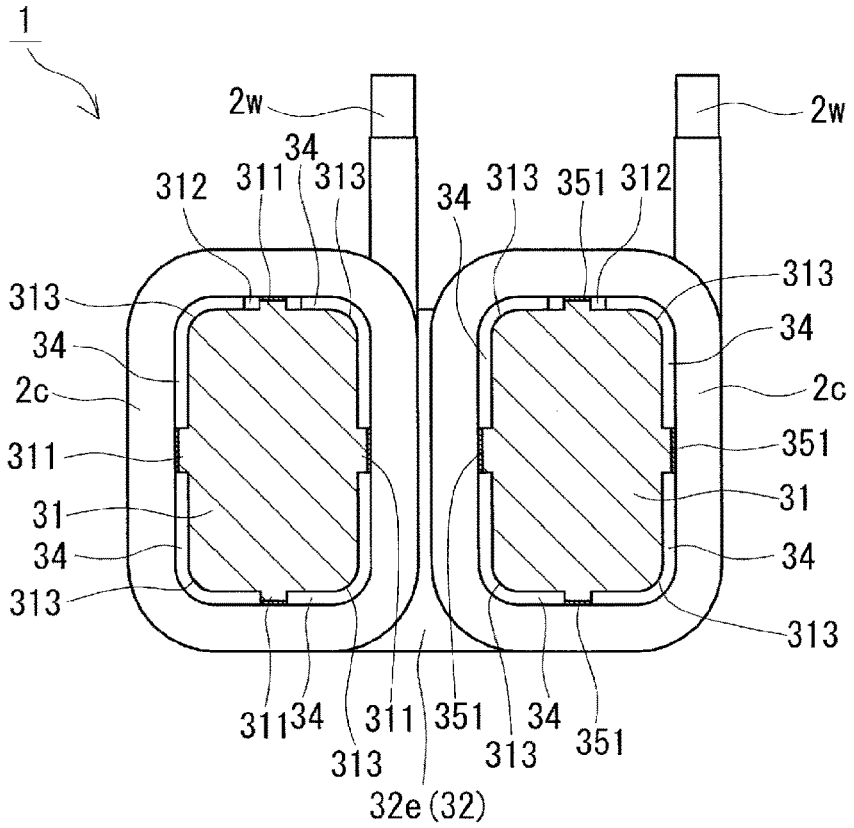
FIG. 3 is a schematic transverse sectional view taken along line (III)-(III) shown in FIG. 1.
Figure 4:
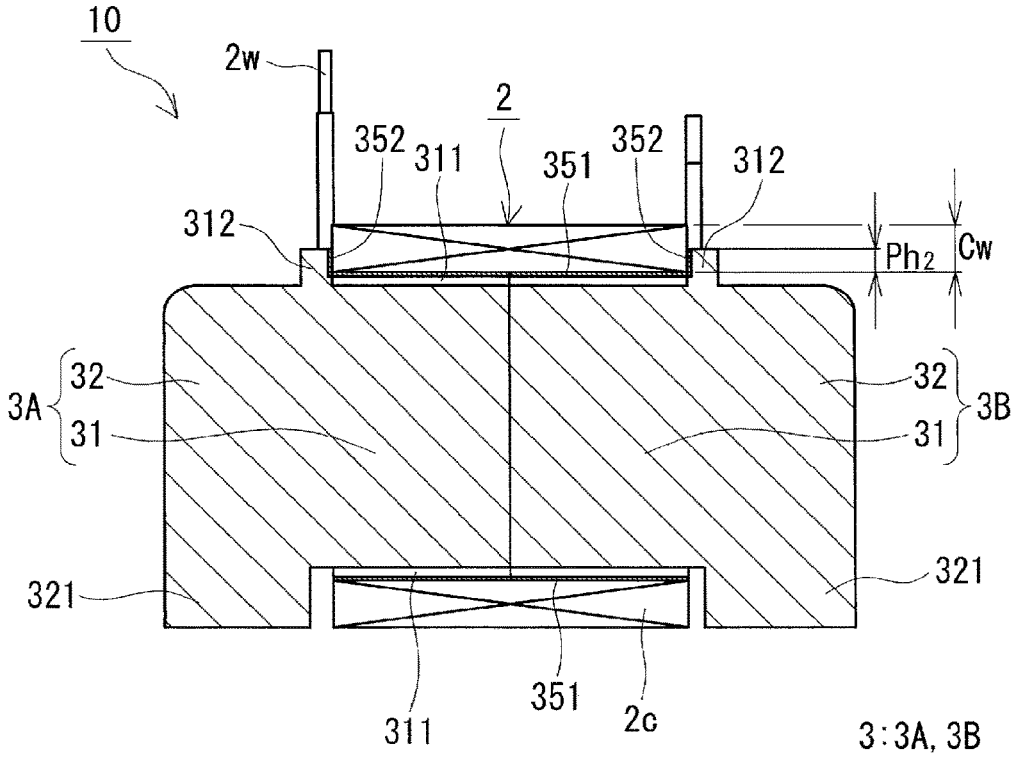
FIG. 4 is a schematic vertical sectional view taken along line (IV)-(IV) shown in FIG. 1.
Figure 5:
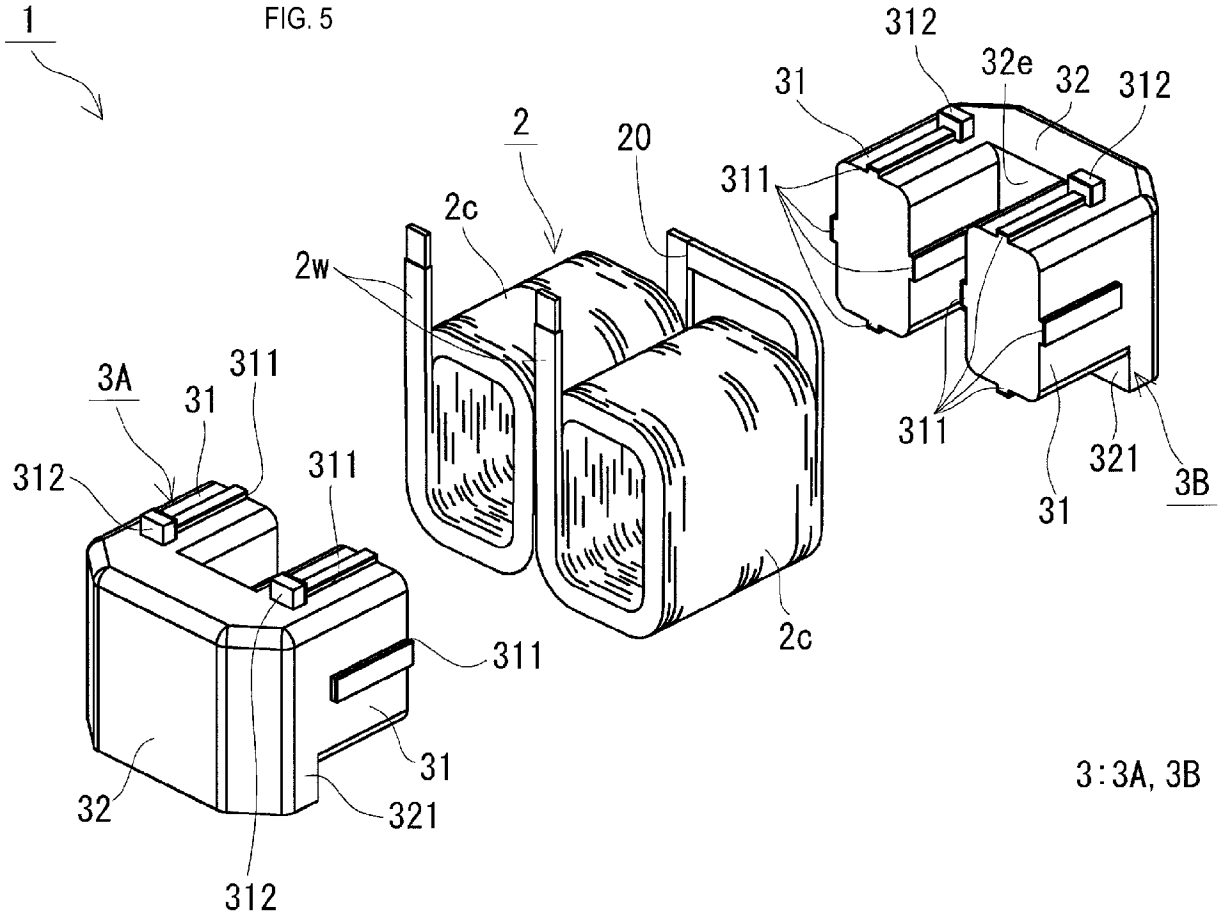
FIG. 5 is a schematic exploded perspective view of the reactor according to the first embodiment.

A reactor 1 according to a first embodiment will now be described with reference to FIGS. 1 to 5. As shown in FIG. 1, the reactor 1 of the first embodiment includes a coil 2 provided with two winding portions 2*c*, and a magnetic core 3 disposed extending inside and outside the winding portions 2*c*. The two winding portions 2*c* are disposed laterally side-by-side with each other. The magnetic core 3 includes magnetic core pieces, and in this example, the magnetic core 3 includes two core pieces 3A and 3B as shown in FIG. 2. As shown in FIGS. 1 and 5 as well, the core pieces 3A and 3B have two inner core portions 31 that are disposed inside the winding portions 2*c*, and outer core portions 32 that are disposed outside the winding portions 2*c* and connect the two inner core portions 31. One feature of the reactor 1 is that the core pieces 3A and 3B, which have the inner core portions 31, are provided with first projections 311 (see FIGS. 2 and 3) that are integrated with and project from the outer peripheral faces of the inner core portions 31, and second projections 312 (see FIGS. 2 and 4) that are integrated with and project from the core pieces 3A and 3B and are located at a positions opposing the end faces of the winding portions 2*c*.

The reactor 1 is installed in an installation target (not shown) such as a converter case. Here, the lower side of the reactor 1 (coil 2 and magnetic core 3) with respect to the paper surface in FIGS. 1 and 5 is the installation side that faces the installation target, and accordingly the installation side will be referred to as the "lower" side, the side opposite thereto will be referred to as the "upper" side, and the up-down direction will be referred to as the vertical direction. Also, the side-by-side direction (left-right direction with respect to the paper surface in FIG. 3) of the winding portions 2*c* (inner core portions 31) will be referred to as the horizontal direction, and the direction extending along the axial direction of the winding portions 2*c* (inner core portions 31) will be referred to as the length direction. FIG. 3 is a transverse sectional view taken along the horizontal direction, which is orthogonal to the axial direction, of the inner core portions 31 (winding portions 2*c*), and FIG. 4 is a vertical sectional view taken along the vertical direction, which conforms to the axial direction of the inner core portions 31 (winding portions 2*c*). The configuration of the reactor 1 will be described in detail below.

Coil

As shown in FIGS. 1 and 5, the coil 2 has a pair of winding portions 2*c* that are each constituted by a winding wire 2*w* coiled in a spiral manner, and end portions on one side of the winding wires 2*w* that form the winding portions 2*c* are connected to each other via a joining portion 20. The two winding portions 2*c* are disposed laterally side-by-side (in parallel) with each other such that the axial directions thereof are parallel with each other. The joining portion 20 is formed by performing welding, soldering, brazing, or the like to join together end portions on one side of the winding wires 2*w* that are drawn out from the winding portions 2*c*. End portions on the other side of the winding wires 2*w* are drawn out in an appropriate direction (upward in this example) from the winding portions 2*c*, and terminal fittings (not shown) are appropriately attached to these end portions for electrical connection to an external apparatus (not shown) such as a power supply. The coil 2 can be a known coil, and the two winding portions 2*c* may be formed by a single continuous winding wire, for example.

Winding Portions

In the two winding portions 2*c*, the winding wires 2*w* have the same specifications, and furthermore, the shapes, sizes, winding directions, and numbers of turns are the same as each other. The winding wires 2*w* are coated wires (so-called enameled wires) that include a conductor (copper or the like) and an insulating coating (polyamide imide or the like) that surrounds the conductor, for example. In this example, as shown in FIG. 5, the winding portions 2*c* are each a quadrangular tube-shaped (specifically, a rectangular tube-shaped) edgewise coil in which the winding wire 2*w*, which is a coated rectangular wire, is wound edgewise. The winding portions 2*c* are not particularly limited to having this shape, and may be cylinder-shaped, elliptical cylinder-shaped, elongated cylinder-shaped (racetrack-shaped) or the like. The specifications of the winding wires 2*w* and the winding portions 2*c* can be changed as appropriate.

Alternatively, the coil 2 may be a molded coil that includes molded electrically insulating resin. In this case, the coil 2 can be protected from the outside environment (dust, corrosion, and the like), and it is possible to improve the mechanical strength of the coil 2. It is also possible to improve the electrical insulation performance of the coil 2 and ensure electrical insulation between the coil 2 and the magnetic core 3. For example, covering the inner peripheral faces of the winding portions 2*c* with resin makes it possible to ensure electrical insulation between the winding portions 2*c* and the inner core portion 31. Examples of the resin formed around the coil 2 include: a thermosetting resin such as epoxy resin, unsaturated polyester resin, urethane resin, or silicone resin; and a thermoplastic resin such as polyphenylene sulfide (PPS) resin, polytetrafluoroethylene (PTFE) resin, liquid crystal polymer (LCP), polyamide (PA) resin such as nylon 6 or nylon 66, polyimide (PI) resin, polybutylene terephthalate (PBT) resin, or acrylonitrile butadiene styrene (ABS) resin.

Alternatively, the coil 2 may be a thermally fused coil in which thermal fusion layers are provided between adjacent turns in the winding portions 2*c*, and the adjacent turns are thus thermally fused together. In this case, it is possible to improve the shape-maintaining strength of the winding portions 2*c* and suppress deformation of the winding portions 2*c*, such as the case where turns in portions of the winding portions 2*c* become shifted in the diameter direction.

Magnetic Core

As shown in FIGS. 2 and 5, the magnetic core 3 includes the two U-shaped core pieces 3A and 3B, and takes a loop shape when the two core pieces 3A and 3B are combined. In this example, the core pieces 3A and 3B have the same shape. For example, the core piece 3B matches the core piece 3A when rotated 180° in the horizontal direction from the state shown in FIG. 2. When the coil 2 receives a supply of electricity and becomes excited, magnetic flux flows in the magnetic core 3, thus forming a closed magnetic circuit.

Core Pieces

As shown in FIGS. 2 and 5, the core pieces 3A and 3B each have two inner core portions 31 and one outer core portion 32, and these three portions are integrated to form a molded body. As shown in FIG. 1, the inner core portions 31 are inserted into the winding portions 2*c*, and are portions that are disposed inside the winding portions 2*c*. In other words, similarly to the winding portions 2*c*, the two inner core portions 31 are disposed laterally side-by-side (in parallel) such that the axial directions thereof are parallel with each other. The shape of the inner core portions 31 of the core pieces 3A and 3B correspond to the shape of the inner peripheral surface of the winding portions 2*c*, and in this example, is a quadrangular column shape (specifically, a rectangular column shape) as shown in FIG. 5 (see FIG. 3 as well). The inner core portions 31 of the core pieces 3A and 3B have the same length in the axial direction as each other. In each core piece, the first projections 311 and the second projections 312 are integrated with the core piece. The first projections 311 and the second projections 312 will be described in detail later.

As shown in FIG. 1, the outer core portions 32 are exposed from the winding portions 2*c*, and are portions that are disposed outside the winding portions 2*c*. As shown in FIGS. 2 and 5, the outer core portions 32 of the core pieces 3A and 3B are each columnar bodies having a hexagonal upper face, and each have an inward end face 32*e* (see FIG. 5) that faces the end faces of the winding portions 2*c*. The two inner core portions 31 of each of the core pieces 3A and 3B project from the inward end face 32*e* of the outer core portion 32 toward the winding portions 2*c*, and the end faces of the inner core portions 31 on the two sides abut against each other to form a loop shape. The inner core portions 31 of the core pieces 3A and 3B are joined to each other with use of an adhesive for example, and thus the core pieces 3A and 3B are integrated with each other. In this example, as shown in FIGS. 4 and 5, the outer core portions 32 each have a lower protruding portion 321 that projects downward beyond the inner core portions 31, and the lower face of the outer core portion 32 is substantially flush with the lower faces of the winding portions 2*c*.

The core pieces 3A and 3B are formed by compacts that have a predetermined shape and are formed by a composite material that includes a magnetic powder and a resin. The composite material compact is manufactured by being molded through a resin molding method such as injection molding or cast molding. In the composite material compact, resin exists between particles of the magnetic powder, thus making it possible to lower the relative permeability. For this reason, in the case where the core pieces 3A and 3B that constitute the magnetic core 3 are composite material compacts, a gap for adjusting the inductance of the reactor 1 does not need to be provided in the magnetic core 3 (e.g., between the core pieces 3A and 3B), or even in the case of providing such a gap, the gap can be small. Accordingly, flux leakage is not likely to occur in the magnetic core 3 (inner core portions 31), and it is possible to reduce the size of a clearance 34 (see FIG. 3) between the inner peripheral faces of the winding portions 2*c* and the outer peripheral faces of the inner core portions 31. Furthermore, the composite material compact can be easily molded as a single body even when having a complex shape that includes projections, and the dimensional precision is high, and therefore if the core pieces 3A and 3B are composite material compacts, it is possible to easily obtain core pieces that have high dimensional precision. Also, in the case of using composite material compacts, it is also possible to expect an effect of being able to reduce core loss such as eddy current loss. If the core pieces 3A and 3B have the same shape as in this example, they can be molded using the same mold, and this is excellent in terms of productivity.

The magnetic powder contained in the composite material can be a powder of a metallic or non-metallic soft magnetic material. In the case of being a metallic material, examples include pure iron that contains substantially only Fe, an iron alloy that contains various additive elements with the remainder being Fe and unavoidable impurities, an iron group metal other than metal, and an alloy thereof. Examples of the iron alloy include an Fe—Si alloy, an Fe—Si—Al alloy, an Fe—Ni alloy, and an Fe—C alloy. One example of the non-metallic material is ferrite.

The resin contained in the composite material can be a thermosetting resin, thermoplastic resin, room temperature curing resin, low temperature curing resin, or the like. Examples of a thermosetting resin include unsaturated polyester resin, epoxy resin, urethane resin, and silicone resin. Examples of a thermoplastic resin include PPS resin, PTFE resin, LCP, PA resin, PI resin, PBT resin, and ABS resin. Alternatively, it is also possible to use a BMC (Bulk Molding Compound), which is obtained by mixing unsaturated polyester with calcium carbonate and glass fibers, millable silicone rubber, millable urethane rubber, or the like. The content amount of the magnetic powder in the composite material is, for example, in the range of 30% to 80% by volume inclusive, or in the range of 50% to 75% by volume inclusive. The content amount of the resin in the composite material is, for example, in the range of 10% to 70% by volume inclusive, or in the range of 20% to 50% by volume inclusive. Also, in addition to the magnetic powder and the resin, the composite material can contain a filler powder that is made of a non-magnetic and non-metallic material such as alumina or silica. The content amount of the filler powder is, for example, in the range of 0.2% to 20% by mass inclusive, in the range of 0.3% to 15% by mass inclusive, or in the range of 0.5% to 10% by mass inclusive. The higher the content amount of the resin is, the smaller the relative permeability is, and the less likely magnetic saturation is to occur, and moreover, the higher the insulation performance rises, and the easier it is to reduce eddy current loss. In the case of containing the filler powder, it is possible to expect effects such as a reduction in loss and an improvement in heat dissipation performance due to an improvement in insulation performance, for example.

First Projections

As shown in FIG. 3, the first projections 311 are integrated with and project from the outer peripheral faces of the inner core portions 31, and come into contact with the inner peripheral faces of the winding portions 2*c* so as to position the winding portions 2*c* in the diameter direction. Also, the first projections 311 reduce the area of contact between the inner peripheral faces of the winding portions 2*c* and the outer peripheral faces of the inner core portions 31, and make it possible to also expect an effect of enabling a reduction in friction resistance when the inner core portions 31 are inserted into the winding portions 2*c*. In this example, the inner core portions 31 are shaped as rectangular columns, and have four flat outer peripheral faces (upper face, lower face, and left and right side faces) and four corner portions 313. The first projections 311 are respectively formed on the faces that constitute the outer peripheral faces of the inner core portions 31, and project from intermediate portions (excluding the corner portions 313) of the faces that constitute the outer peripheral faces, in a cross section (transverse section) taken along a direction that is orthogonal to the axial direction of the inner core portions 31. There are no particular limitations on the shapes and positions of the first projections 311 as well as the number thereof. In this example, the first projections 311 have a rectangular cross-sectional shape, but the cross-sectional shape may be trapezoidal, semicircular, or the like. Also, although one first projection 311 is formed at an intermediate position on each face here, a plurality of first projections 311 may be formed on each face, and a plurality of first projections 311 may be formed in the intermediate portion of each face. The first projections 311 result in the formation of clearances 34 (see FIG. 3) between the inner peripheral faces of the winding portions 2*c* and the outer peripheral faces of the inner core portions 31 (excluding the first projections 311). In this example, four first projections 311 are formed on the outer peripheral faces of each of the inner core portions 31, and the clearance 34 is ensured at the four corners of each of the inner core portions 31.

The height of the first projections 311 is in the range of 100 μm to 1 mm inclusive, for example. If the height of the first projections 311 is less than or equal to 1 mm, the clearances 34 between the winding portions 2*c* and the inner core portions 31 can be made sufficiently small. If the height of the first projections 311 is greater than or equal to 100 μm, the clearances 34 can be reliably ensured, and it is more likely to ensure electrical insulation between the winding portions 2*c* and the inner core portions 31. It is more preferable that the height of the first projections 311 is in the range of 200 μm to 800 μm inclusive, for example. In this case, the first projections 311 all have the same height. Note that in this example, electrical insulation between the first projections 311 and the winding portions 2*c* is ensured by later-described insulation layers 351.

The width of the first projections 311 is in the range of 1 mm to 20 mm inclusive, for example. The "width of the first projections 311" mentioned here refers to the length along the peripheral direction of the outer peripheral faces of the inner core portions 31. If the width of the first projections 311 is greater than or equal to 1 mm, it is more likely to ensure mechanical strength for the first projections 311, and if less than or equal to 20 mm, it is possible to reduce the area of contact between the inner peripheral faces of the winding portions 2*c* and the outer peripheral faces of the first projections 311, and it is more likely to reduce friction resistance when the inner core portions 31 are inserted into the winding portions 2*c*. From the viewpoint of reducing the area of contact (frictional resistance) with the inner peripheral faces of the winding portions 2*c*, it is more preferable that the width of the first projections 311 is, for example, less than or equal to ½ of, or furthermore less than or equal to ⅓ of, the width of the outer peripheral faces of the inner core portions 31 on which the first projections 311 are formed.

In this example, as shown in FIG. 4, the first projections 311 are continuous over the entire axial length of the inner core portions 31. If the first projections 311 are continuous over the entire length of the inner core portions 31, it is possible to suppress the case where some of the turns that form the winding portions 2*c* shift in the diameter direction. The first projections 311 may be non-continuous and have gaps along the axial direction of the inner core portions 31.

If the first projections 311 are continuous along the axial direction of the inner core portions 31, the first projections 311 can also be used as magnetic paths. In this example, as shown in FIG. 3, the first projections 311 are formed in intermediate portions of the faces that constitute the outer peripheral faces of the inner core portions 31, but the first projections 311 may also be formed on the corner portions 313. However, magnetic flux does not easily flow in the corner portions 313 of the inner core portions 31, and these corner portions are not likely to function as effective magnetic paths. For this reason, if the first projections 311 are formed in the intermediate portions of the faces as shown in FIG. 3, the first projections 311 are more likely to function as effective magnetic paths and contribute to ensuring the effective magnetic path sectional area, compared with the case of being formed on the corner portions 313.

Second Projections

As shown in FIG. 4, the second projections 312 are integrated with and project from the core pieces 3A and 3B at positions opposing the end faces of the winding portions 2*c*, and come into contact with the end faces of the winding portions 2*c* so as to position the winding portions 2*c* in the axial direction. In this example, the second projections 312 are formed on the upper faces of the core pieces 3A and 3B so as to oppose upper portions of the end faces of the winding portions 2*c*, and project from the boundary portion between the inner core portions 31 and the outer core portions 32 so as to sandwich the end faces of the winding portions 2*c* from the two sides (see FIG. 1 as well). As long as the second projections 312 abut against the end faces of the winding portions 2*c* and position the winding portions 2*c* in the axial direction relative to the magnetic core 3, there are no particular limitations on the shape and positions of the second projections 312 as well as the number thereof.

The height of the second projections 312 is, for example, greater than or equal to ⅓ the width of the end faces of the winding portions 2*c*. The "height of the end faces of the winding portions 2*c*" mentioned here refers to the dimension between the inner peripheral faces and the outer peripheral faces at the end faces of the winding portions 2*c* (indicated by Cw in FIG. 4), and is substantially the same as the width of the winding wires 2*w* that form the winding portions 2*c*. Also, the "height of the second projections 312" is the height of the portions that come into contact with the end faces of the winding portions 2*c*, and is the dimension from the position of the inner peripheral faces at the end faces of the winding portions 2*c* (indicated by Phe in FIG. 4). If the height of the second projections 312 is greater than or equal to ⅓ of the width of the end faces of the winding portions 2*c*, the second projections 312 are more likely to abut against the end faces of the winding portions 2*c*, and it is possible to effectively position the winding portions 2*c* in the axial direction. It is more preferable that the height of the second projections 312 is, for example, greater than or equal to ½ the width of the end faces of the winding portions 2*c*. Although there are no particular limitations on the height of the second projections 312, this height is less than or equal to the width of the end faces of the winding portions 2*c*, for example.

The width of the second projections 312 is greater than or equal to 3 mm, for example. The "width of the second projections 312" mentioned here refers to the length along the peripheral direction of the winding portions 2*c* (see FIG. 1 as well). If the width of the second projections 312 is greater than or equal to 3 mm, it is more likely to ensure mechanical strength for the second projections 312, and the size of the portions that come into contact with the end faces of the winding portions 2*c* increases, and therefore it is easier to stably position the winding portions 2*c* in the axial direction. The thickness of the second projections 312 need only be a thickness that enables ensuring a mechanical strength sufficient for supporting the end faces of the winding portions 2*c*, and is greater than or equal to 1 mm, for example. The "thickness of the second projections 312" mentioned here refers to the dimension along the axial direction of the winding portions 2*c*. The thickness of the second projections 312 is preferably as small as possible while also being able to ensure a sufficient mechanical strength, one example being a thickness less than or equal to 5 mm.

Although the second projections 312 are formed on the upper faces of the core pieces 3A and 3B in this example, the second projections 312 may be formed on other faces such as the outward faces (outward faces with respect to the width direction of the magnetic core 3) of the core pieces 3A and 3B, for example. Furthermore, the second projections 312 can also be flange-shaped so as to oppose the end faces of the winding portions 2*c* over the entire periphery thereof. By increasing the formation regions of the second projections 312 in this way, it is easier to more stably position the winding portions 2*c* in the axial direction.

Insulation Layers

In this example, as shown in FIGS. 2 and 3, insulation layers 351 are disposed on the outer peripheral faces of the first projections 311, and insulation layers 352 are disposed on the inward end faces of the second projections 312 that oppose the end faces of the winding portions 2*c*. The insulation layers 351 on the first projections 311 are disposed between the inner peripheral faces of the winding portions 2*c* and the outer peripheral faces of the first projections 311, and ensure electrical insulation between the winding portions 2*c* and the inner core portions 31. The insulation layers 352 on the second projections 312 are disposed between the end faces of the winding portions 2*c* and the inward end faces of the second projections 312, and ensure electrical insulation between the winding portions 2*c* and the core pieces 3A and 3B. The thickness of the insulation layers 351 and 352 need only be sufficient to ensure insulation between the winding portions 2*c* (coil 2) and the core pieces 3A and 3B (magnetic core 3), and one example is a thickness in the range of 10 μm to 500 μm inclusive. For example, if the thickness of the insulation layers 351 is less than or equal 500 μm, the clearances 34 (see FIG. 3) between the winding portions 2*c* and the inner core portions 31 can be made sufficiently small. If the thickness of the insulation layers 351 and 352 is greater than or equal to 10 μm, it is possible to ensure sufficient insulation between the winding portions 2*c* and the core pieces 3A and 3B. The thickness of the insulation layers 351 and 352 is more preferably in the range of 20 μm to 300 μm inclusive, for example. Although the insulation layers 351 are disposed on only the outer peripheral faces of the first projections 311 that are adjacent to the inner peripheral faces of the winding portions 2*c* in this example, it is sufficient that the insulation layers 351 are disposed on at least the outer peripheral faces of the first projections 311, and the insulation layers 351 may be disposed so as to surround the first projections 311. In the case where the insulation layers 351 are disposed on the outer peripheral faces of the first projections 311, the total of the height of the first projection 311 and the thickness of the insulation layer 351 is favorably in the range of 110 μm to 1 mm inclusive, for example.

The insulation layers 351 and 352 are formed from an electrically insulating material. Also, it is desirable that the insulation layers 351 and 352 (particularly the insulation layers 351) are as thin as possible, and from this viewpoint, the insulation layers may be formed by affixing insulating paper or resin insulating tape, or applying a resin powder coating or an insulating coating such as varnish, for example. The resin contained in the powder coating can be epoxy resin, polyester resin, acrylic resin, fluororesin, or the like.

Actions and Effects

The reactor 1 of the first embodiment has actions and effects such as the following.

The core pieces 3A and 3B that constitute the magnetic core 3 are composite material compacts, thus making it unlikely for flux leakage to occur in the magnetic core 3 (inner core portions 31) and making it possible to reduce the size of the clearances 34 between the winding portions 2*c* and the inner core portions 31. Also, the core pieces 3A and 3B include the first projections 311 that are integrated with and project from the outer peripheral faces of the inner core portions 31, and the second projections 312 that are integrated with and project from the core pieces 3A and 3B at positions opposing the end faces of the winding portions 2*c*. The winding portions 2*c* are positioned in the diameter direction by the first projections 311, and the winding portions 2*c* are positioned in the axial direction by the second projections 312, thus making it possible to position the coil 2 relative to the magnetic core 3. For this reason, it is possible to omit bobbins that have been conventionally used (inner bobbins and frame-shaped bobbins), and it is possible to reduce the size of the clearances 34 between the winding portions 2*c* and the inner core portions 31 and to reduce the number of components. Accordingly, with the reactor 1, the coil 2 and the magnetic core 3 can be positioned with a simple configuration, and furthermore it is possible to reduce the size of the clearances 34 between the winding portions 2*c* and the inner core portions 31, and to achieve compactness.

Applications

The reactor 1 of the first embodiment can be favorably applied to various types of converters such as in-vehicle converters (typically DC-DC converters) for installation in a vehicle such as a hybrid automobile, a plug-in hybrid automobile, an electric automobile, or a fuel cell automobile, and furthermore can be favorably applied to a constituent component of a power conversion apparatus, for example.

Variations

At least one of the following changes or additions can be made to the reactor 1 of the first embodiment described above.

In the aspect of the reactor 1 of the first embodiment, at least a portion of the assembly constituted by the coil 2 and the magnetic core 3 is molded from a resin. In this case, the assembly can be protected from the outside environment (dust, corrosion, and the like), and the assembly can be protected electrically and mechanically. Examples of the resin for molding the assembly include a thermosetting resin such as epoxy resin, unsaturated polyester resin, urethane resin, and silicone resin, and a thermoplastic resin such a PPS resin, PTFE resin, LCP, PA resin, PI resin, PBT resin, and ABS resin.

In the aspect described in the first embodiment, the reactor 1 includes a case (not shown) for housing the assembly constituted by the coil 2 and the magnetic core 3. Accordingly, the assembly can be protected from the outside environment (dust, corrosion, and the like), and the assembly can be protected mechanically. If the case is made of metal, the entirety of the case can be used as a heat dissipation path, thus making it possible for heat generated by the coil 2 and the magnetic core 3 to be efficiently dissipated to the outside installation target, and heat dissipation performance is improved. Examples of the material for forming the case include aluminum and an alloy thereof, magnesium and an alloy thereof, copper and an alloy thereof, silver and an alloy thereof, iron, steel, and austenitic stainless steel. In the case of using aluminum, magnesium, or an alloy thereof, the weight of the case can be reduced. The case may be made of a resin.

Also, in the case where the assembly is housed in the case, the reactor may include a sealing resin member for sealing the assembly in the case. This makes it possible to ensure electrical and mechanical protection of the assembly, protection from the outside environment, and the like. Examples of the resin in the sealing resin member include epoxy resin, urethane resin, silicone resin, unsaturated polyester resin, and PPS resin. From the viewpoint of improving the heat dissipation performance, a high thermal conductivity ceramic filler made of alumina, silica, or the like may be mixed with the sealing resin.

The invention claimed is:

1. A reactor comprising a coil having a winding portion, and a magnetic core including a core piece having an inner core portion disposed inside the winding portion, wherein the core piece is a compact made of a composite material that contains a magnetic powder and a resin, and the reactor further comprises:

a first projection that projects from an outer peripheral face of the inner core portion, the first projection being integrally formed as a single piece with the core piece so as to be formed of the composite material, and comes into contact with an inner peripheral face of the winding portion so as to position the winding portion in a diameter direction of the winding portion; and a second projection that projects from the core piece at a position opposing an end face of the winding portion, the second projection being integrally formed as a single piece with the core piece so as to be formed of the composite material, and comes into contact with the end face of the winding portion so as to position the winding portion in an axial direction of the winding portion.

2. The reactor according to claim 1, wherein a height of the first projection is less than or equal to 1 mm.

3. The reactor according to claim 1, wherein a height of the second projection is greater than or equal to ⅓ of a width of the end face of the winding portion.

4. The reactor according to claim 1, wherein the first projection is continuous over an entire length of the inner core portion.

5. The reactor according to claim 1, further comprising:

an insulation layer that is provided on an outer peripheral face of the first projection and is disposed between an inner peripheral face of the winding portion and the outer peripheral face of the first projection.

6. The reactor according to claim 1, further comprising:

an insulation layer that is provided on an inward end face of the second projection that opposes the end face of the winding portion, and is disposed between the end face of the winding portion and the inward end face of the second projection.

7. The reactor according to claim 5, wherein a thickness of the insulation layer is less than or equal to 500 μm.

8. The reactor according to claim 2, wherein a height of the second projection is greater than or equal to ⅓ of a width of the end face of the winding portion.

9. The reactor according to claim 2, wherein the first projection is continuous over an entire length of the inner core portion.

10. The reactor according to claim 3, wherein the first projection is continuous over an entire length of the inner core portion.

11. The reactor according to claim 2, further comprising:

an insulation layer that is provided on an outer peripheral face of the first projection and is disposed between an inner peripheral face of the winding portion and the outer peripheral face of the first projection.

12. The reactor according to claim 3, further comprising:

an insulation layer that is provided on an outer peripheral face of the first projection and is disposed between an inner peripheral face of the winding portion and the outer peripheral face of the first projection.

13. The reactor according to claim 4, further comprising:

an insulation layer that is provided on an outer peripheral face of the first projection and is disposed between an inner peripheral face of the winding portion and the outer peripheral face of the first projection.

14. The reactor according to claim 2, further comprising:

an insulation layer that is provided on an inward end face of the second projection that opposes the end face of the winding portion, and is disposed between the end face of the winding portion and the inward end face of the second projection.

15. The reactor according to claim 3, further comprising:

an insulation layer that is provided on an inward end face of the second projection that opposes the end face of the winding portion, and is disposed between the end face of the winding portion and the inward end face of the second projection.

16. The reactor according to claim 4, further comprising:

an insulation layer that is provided on an inward end face of the second projection that opposes the end face of the winding portion, and is disposed between the end face of the winding portion and the inward end face of the second projection.

17. The reactor according to claim 5, further comprising:

an insulation layer that is provided on an inward end face of the second projection that opposes the end face of the winding portion, and is disposed between the end face of the winding portion and the inward end face of the second projection.

18. The reactor according to claim 6, wherein a thickness of the insulation layer is less than or equal to 500 μm.

* * * * *